United States Patent [19]

Payne

[11] Patent Number: 4,501,427

[45] Date of Patent: Feb. 26, 1985

[54] TARGET APPARATUS

[76] Inventor: Vay B. Payne, 1 Boundary St., Beaudesert, Queensland, 4285, Australia

[21] Appl. No.: 582,571

[22] PCT Filed: Jun. 9, 1983

[86] PCT No.: PCT/AU83/00079

§ 371 Date: Feb. 7, 1984

§ 102(e) Date: Feb. 7, 1984

[87] PCT Pub. No.: WO83/04433

PCT Pub. Date: Dec. 22, 1983

[30] Foreign Application Priority Data

Jun. 9, 1982 [AU] Australia ..... PF4370

[51] Int. Cl.[3] ..... F41J 7/00; F41J 1/02

[52] U.S. Cl. ..... 273/406

[58] Field of Search ..... 273/406; 74/109, 422

[56] References Cited

U.S. PATENT DOCUMENTS

| | | | |
|---|---|---|---|
| 160,288 | 3/1875 | Simmons | 74/91 X |
| 353,191 | 11/1886 | White | 74/422 X |
| 894,078 | 7/1908 | Stuart | 74/109 X |
| 1,738,874 | 12/1929 | Domingo . | |
| 1,951,906 | 3/1934 | Hansen | 74/109 |
| 2,284,510 | 5/1942 | Cates . | |
| 2,632,196 | 3/1953 | Rappl | 74/109 X |
| 2,912,870 | 11/1959 | Green | 74/109 |
| 3,243,894 | 4/1966 | Ricklick | 74/109 X |
| 3,348,843 | 10/1967 | Stanley . | |
| 3,914,879 | 10/1975 | Taylor | 273/406 X |
| 4,189,147 | 2/1980 | Schmid . | |
| 4,330,129 | 5/1982 | Meredith | 273/406 X |

FOREIGN PATENT DOCUMENTS

| | | | |
|---|---|---|---|
| 44355/68 | 4/1971 | Australia . | |
| 1465554 | 12/1966 | France | 273/406 |
| 230096 | 12/1943 | Switzerland | 273/406 |
| 240632 | 5/1946 | Switzerland . | |

*Primary Examiner*—Paul E. Shapiro

*Attorney, Agent, or Firm*—Larson and Taylor

[57] ABSTRACT

A target apparatus for pistol shooters has a plurality of target boards (28) provided at spaced intervals in a frame, the lower frame member (10) of which is hollow. Each support (30) for each target board (28) has an axle (34) journalled in a mounting plate (36) on the lower frame member (10), with a pinion wheel (37) on each axle (34). Respective racks (42) are provided on an operating rod (39) which is reciprocally moved by a double acting pneumatic cylinder (13). A damping assembly (44) has a piston (48), connected to the operating rod (39), slidably movable in a cylinder (45) which has bleed holes (55) at each end to damp the movement of the piston (48) and inlet holes (56) normally closed by a valve (57) which enables the cylinder to be maintained full of oil as the piston (48) moves in the cylinder. Oil fills the lower frame member (10) and acts as the damping medium, the oil being in free communication with the cylinder when the piston (48) is intermediate its stroke, where no damping is required.

7 Claims, 4 Drawing Figures

TARGET APPARATUS

BACKGROUND OF THE INVENTION (1) Field of the Invention

This invention relates to improvements in or relating to target apparatus for use on a firing range.

(2) Description of the Prior Art

International standards for pistol target shooting require five (5) targets to be mounted on a frame and all are operated together to face the shooter for a predetermined period and then rotate through 90° to be side-on to the shooter. The standards require that the targets be rotated within 0.3 seconds and that no vibration be discernible at 25 meters. Various targets have been proposed to comply with these standards and an example is disclosed in Australian Pat. No. 441,741 (Australasian Training Aids Pty. Ltd.). This patent discloses a target apparatus where each target is provided with a pair of cranks, above and below the targets, the cranks being connected to operating rods driven by double-acting hydraulic or pneumatic rams, the vibration being controlled by pairs of buffers or dampers at the top and bottom of each target, the targets being held against the buffers in the face-on and side-on positions.

This apparatus has a number of disadvantages. As the targets rotate, the operating rods are moved laterally, as well as longitudinally, so that the force applied by the rams is no longer directly along the axis of the operating rods. Secondly, the targets do vibrate when they strike the buffers and the shock loads generate vibration in the frame, requiring a heavy frame to withstand the load.

BRIEF SUMMARY OF THE PRESENT INVENTION

It is an object of the present invention to provide a target apparatus where the operating mechanism is enclosed and protected from the elements.

It is a preferred object to provide an apparatus which fully complies with the International Standards hereinbefore discussed.

It is a further preferred object to provide an apparatus which requires only one hydraulic or pneumatic ram which operates an operating bar or rod, all operating loads being along the axis of the bar or rod.

It is a still further preferred object to provide a highly efficient damping mechanism which uses the oil which lubricates the operating mechanism as its dampening medium.

Other preferred objects will become apparent from the following description.

In one embodiment, the present invention resides in a target apparatus including:

a framework having upright side members and substantially horizontal upper and lower frame members between the side members, the lower frame member being hollow;

means rotatably mounted on the upper and lower frame members for supporting at least one target therebetween;

a pinion or gear wheel in the lower frame member connected to the target support means;

a rack or operating rod slidably mounted in the lower frame member in operating engagement with the pinion or gear wheel;

means to reciprocate the rack or operating rod to rotate the target support means; and damping means connected to the rack or operating rod to damp the movement of the rack or operating rod.

Preferably the lower frame member is filled with oil which acts to lubricate and protect the operating mechanism of the apparatus.

Preferably a respective rack is provided on the operating rod for each target support means and the racks are preferably adjustable to enable the racks and pinions to be correctly meshed.

Preferably the target support means are provided with sockets to releasably receive a target board, so that the target may be removed for repair or replacement.

Preferably the side members and upper frame members may be disassembled for storage.

Preferably the damping means incorporates a cylinder in communication with the interior of the lower frame member so that the oil also acts as a damping medium. Preferably a piston is slidably mounted in the cylinder and each end of the cylinder has one or more bleed holes to enable the controlled escape of oil from the end of the cylinder as the piston approaches it. Preferably a valve is provided in each end of the cylinder, the valve in the end spaced from the piston opening to enable the adjacent end of the cylinder to fill with oil.

BRIEF DESCRIPTION OF THE DRAWINGS

To enable the invention to be fully understood, a preferred embodiment will now be described with reference to the accompanying drawings, in which.

DETAILED DESCRIPTION OF THE PREFERRED EMBODIMENT

Figure 4:
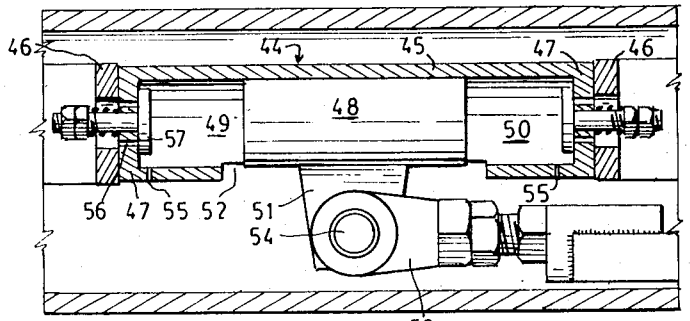
FIG. 4 is a partly sectioned plan view, to further enlarged scale, of the damping means of the assembly.
Figure 1:
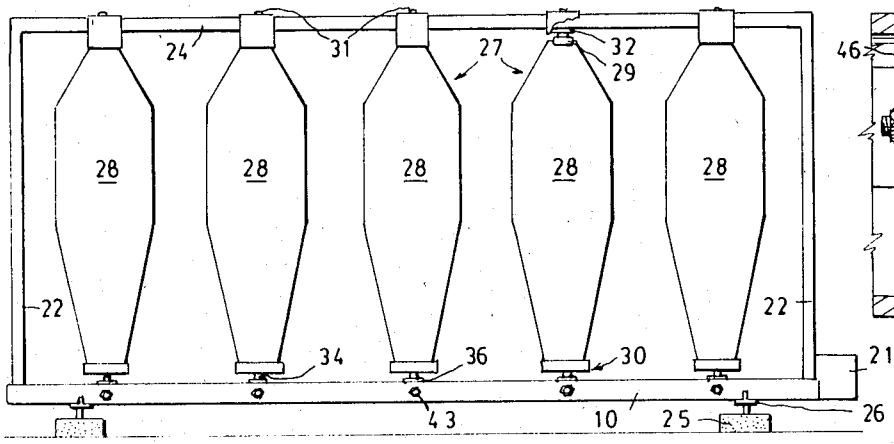
FIG. 1 is a front elevational view, partly broken-away, of the target assembly.
Figure 2:
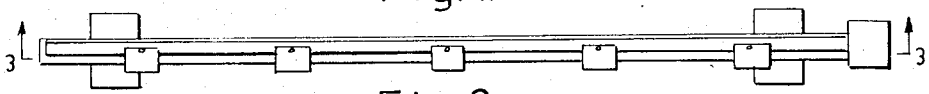
FIG. 2 is a plan view of the assembly.
Figure 3:
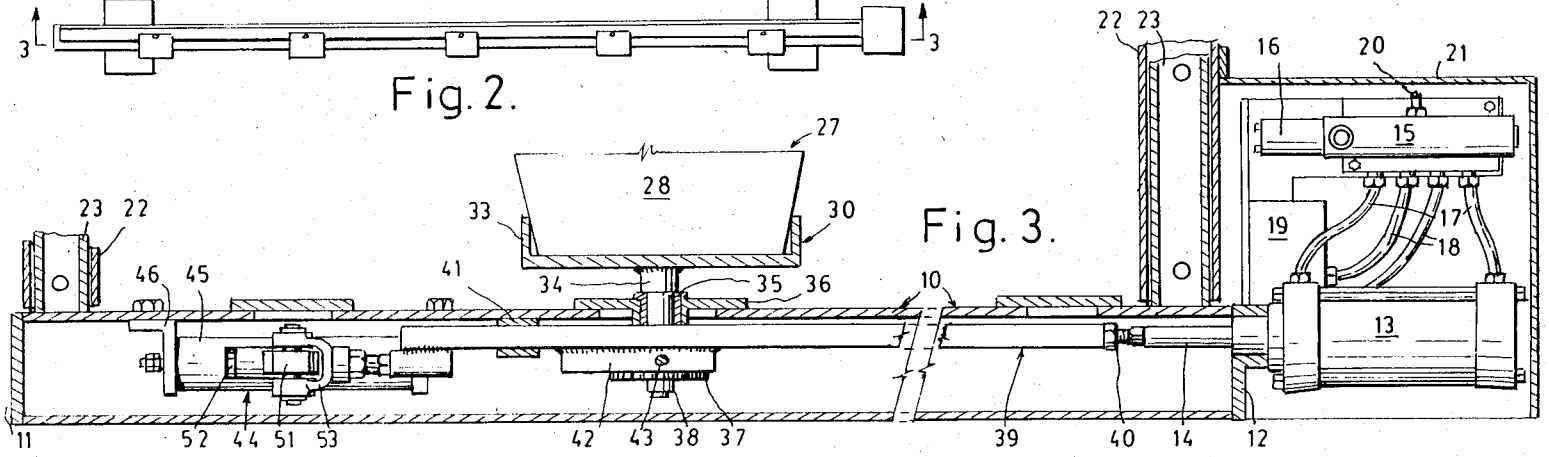
FIG. 3 is a partly broken-away sectional view along line 3–3 in FIG. 2, to larger scale.

The target apparatus has a lower frame member 10 of rolled hollow section (RHS) steel, which is closed at one end by a cap 11 and at the other end by a mounting block 12 for a double acting pneumatic cylinder 13, which has a piston rod 14 screw-threaded at its free end.

The cylinder 13 is operated by compressed air directed to it by a spool valve 15 controlled by a solenoid 16. Pressure lines 17 connect the spool valve to the cylinder, while exhaust lines 18 connect the spool valve to a muffler box 19. An airline 20 connects the spool valve to a remote source of compressed air (not shown) and electric cables (not shown) connect the solenoid to a control box (also not shown) at the shooting position.

The cylinder 13, spool valve 15, solenoid 16 and muffler box 19 are enclosed in a removable protective housing 21.

An upright 22 (of RHS steel) is provided at each end of the target apparatus and each upright releasably receives a locating post 23 fixed on the lower frame member 10. The uprights are connected by a horizontal upper frame member 24 (also of RHS steel).

The lower frame member 10 is secured to concrete blocks 25 by mounting legs 26 to securely hold the target apparatus in position.

Five target assemblies 27 are provided at spaced intervals along the apparatus. Each assembly has a replaceable target board 28 releasably held in upper and lower target supports 29, 30 rotatably mounted on the frame. The upper target support 29 has a socket provided with a clamping means (not shown) to releasably engage the head of the target board and a pivot pin 31 rotatably journalled in a nylon bush 32 fixed in the upper frame member 24.

The lower support 30 has a socket 33 also provided with a clamping means (not shown) to releasably engage the tail of the target board 28. A vertical axle 34 is provided on the socket 33 and is journalled in a brass bush 35 fitted in a housing in a removable mounting plate 36. The mounting plate closes a respective aperture in the upper wall of the lower frame member 10 and is releasably secured thereto by studs (not shown). A pinion wheel 37 is keyed to the axle 34 and secured thereto by a nut 38.

An operating rod 39 has a screwthreaded socket 40 at one end to receive and engage the free end of the piston rod 14. The operating rod 39 is supported at spaced intervals along the lower frame member 10 by sliding bearings 41 fixed to the upper wall of the lower frame member. A rack 42 is welded to the operating rod adjacent each pinion wheel to engage with the latter so that longitudinal reciprocating movement of the operating rod is translated into rotational movement of the target boards 28 by the pinion wheel 37/rack 42 combinations. (Adjusting screws 43 are screwthreadably mounted in the lower frame member 10 to bear on the racks 42 to ensure correct meshing between the pinion wheels and the racks). The gearing ratio between the racks and the pinions is selected so that the full stroke of the piston rod 14 results in a 90° rotation of the target boards 28 from the side-on to face-on, or vice versa, positions respectively.

For repair or maintenance, the studs securing the mounting plates 36 may be removed and the mounting plates, lower sockets 33 and pinion wheels 37 may be lifted free of the lower support member in a single unit.

The interior of the lower frame member 10 is filled with oil to lubricate the pinion wheels 37 and racks 42 and to act as the damping medium in the manner to be hereinafter described.

A single damping means 44 is provided in the lower frame member 10 at the opposite end of the operating rod 39 to the cylinder 13. The damping means has a damping cylinder 45 fixed to the upper wall of the frame member by a pair of mounting brackets 46. The cylinder 45 has a plain bore and is closed at each end by end walls 47. A piston 48 is slidably movable in the bore to divide the cylinder into two variable capacity chambers 49, 50. The piston 48 has a lateral arm 51, extending through an elongate slot 52 in the wall of the cylinder 45 connected to a clevis 53 on the free end of the operating rod 39 by a pivot pin 54.

One or more bleed holes 55 are provided in each chamber 49, 50 to enable a controlled bleed of oil from the chambers as their volume is decreased by the movement of the piston 48. A pair of inlet holes 56 are provided in each end wall 47 of the cylinder 45 and these are normally closed by a spring-loaded valve 57. As the piston 48 moves to reduce the volume of chamber 49, the valve 57 in chamber 50 is unseated due to the lower pressure in that chamber and the valve 57 in that chamber is unseated to ensure that the chamber is maintained full of oil. When the piston 48 is in the intermediate portion of its stroke, both chambers 49, 50 are in free communication with the oil in the lower frame member so that the piston can travel freely through the cylinder, the damping action only being required at each end of its stroke.

The operation of the apparatus will now be described.

The apparatus is assembled as shown and connected to a source of compressed air. The cylinder 13 is operated to retract the piston rod 14 so that the target boards 28 are side-on to the shooters.

An operator operates a switch which sets a timing circuit in operation. The timing mechanism operates the solenoid 16, which operates the spool valve 15, causing air to enter the cylinder 13 to extend the piston rod 14 to full extent of its stroke in under 0.3 seconds. As the piston rod is extended, the racks 42 on the operating rod 39 cause the pinion wheel 37 to rotate, thereby rotating the target boards 28 through 90° to be face-on to the shooter.

The operating rod 39 also causes piston 48 to move in the cylinder to reduce the volume of chamber 49 and so oil is forced out of that chamber through its bleed holes 55. At the same time, the lowered pressure in chamber 50 causes the springloaded valve 57 to be opened and oil flows into that chamber through the inlet holes 56. The piston 48 initially moves relatively freely in the cylinder 45 as the oil flows through the slot 52 but as it approaches the end wall 47, the restricted flow of oil through the bleed holes 55 opposes its movement and a damping force is applied to the piston (and the operating rod). When the target boards 28 are face-on to the shooter, the piston 48 is spaced a small distance from the valve 57.

After a preset time, e.g. 10 seconds, the timer operates the solenoid 16 and the cylinder 13 retracts the piston rod in under 0.3 seconds to turn the target boards to their initial side-on position. As the piston 48 moves to reduce the volume of chamber 50, the damping force is applied to the piston and operating rod in the same manner as hereinbefore described.

Experiments have shown that with the pneumatic cylinder fitted to the prototype of the invention, the target boards can be rotated through 90° in 0.3 seconds by an air pressure of 100 p.s.i. and in 0.18 seconds by an air pressure of 130 p.s.i. The damping means ensures that there is no visible vibration or oscillation of the target boards when they reach the face-on or side-on position.

Compared with the prior target apparatus hereinbefore described the described embodiment of the present invention has the following advantages:

(1) only one hydraulic or pneumatic cylinder is used, not two, and the selection of a suitable cylinder and piston stroke enables the apparatus to be operated with a much lower volume of air, or oil than with presently available equipment;

(2) as the cylinder is mounted on the lower frame member, all oil, air or electrical lines are kept close to the ground, avoiding bullet damage;

(3) all working parts are enclosed in the lower frame member and are protected from weather, bullet damage and vandalism, the oil in the frame members ensuring a long working life;

(4) the oil in the frame member is also used as a damping medium in the single damping cylinder and only one damping means, not twenty, is required for five targets;

(5) the side members and upper frame members are detachable for storage, and may be of much lighter construction as much lower shock loads are transmitted to the frame as virtually "nil" torque is fed to the frame as the targets are rotated; and (6) manufacturing and assembling times of the apparatus are much less than previous apparatuses.

It will be readily apparent to the skilled addressee that various changes and modifications may be made to the embodiment described without departing from the scope of the present invention.

I claim:

1. A target apparatus including:

a framework having upright side members and substantially horizontal upper and lower frame members between the side members, the lower frame member being hollow;

means rotatably mounted on the upper and lower frame members for supporting at least one target therebetween;

a gear wheel in the lower frame member connected to the target support means;

an operating rod slidably mounted in the lower frame member in operating engagement with the gear wheel;

means to reciprocate the operating rod to rotate the target support means; and damping means connected to the operating rod to damp the movement of the operating rod, the lower frame member being filled with oil, and the damping means including a cylinder in communication with the interior of the lower frame member so that the oil acts as a damping medium.

2. A target apparatus as claimed in claim 1 wherein:

a piston is slidably mounted in the cylinder and is operatively connected to the operating rod; and each end of the cylinder has at least one bleed hole to enable the controlled escape of oil from the end of the cylinder as the piston approaches it to damp or decelerate the piston.

3. A target apparatus as claimed in claim 2 wherein:

a valve is provided in each end of the cylinder so arranged that the valve in the end spaced from the piston opens to enable the end of the cylinder to fill with oil.

4. A target apparatus as claimed in claim 3 wherein:

an elongated slot is formed in the cylinder;

an arm on the piston extends through the slot to operatively connect the piston to the rack or operating rod;

the slot being so arranged that intermediate the stroke of the piston, the oil in the cylinder is in free communication with the interior of the lower frame member so that no damping force is applied to the piston.

5. A target apparatus as claimed in claim 1 wherein:

a respective rack is provided on the operating rod for each gear wheel, the racks being adjustable to enable the racks and gear wheels to be correctly meshed.

6. A target apparatus as claimed in claim 1 wherein:

each target support means includes a lower socket to releasably receive a target board, a mounting plate on the lower frame member; and an axle on the socket rotatably journalled in the mounting plate, the gear wheel being provided on the axle.

7. A target apparatus as claimed in claim 1 wherein:

the means to reciprocate the rack or operating rod includes a double acting pneumatic cylinder connected to a source of compressed air and controlled by a valve means; and a timing means controlling the valve means to operate the pneumatic cylinder so that the targets are rotated to a face-on shooting position for a preselected period.

* * * * *